US006075509A

United States Patent [19]

Ellis, II et al.

[11] Patent Number: 6,075,509

[45] Date of Patent: Jun. 13, 2000

[54] INTEGRATED MULTIPLEX DRIVE SYSTEM FOR A PASSIVE LIQUID CRYSTAL DISPLAY (LCD) USING MODULATED PULSE WIDTHS

[75] Inventors: David L. Ellis, II, Coconut Creek; Ruben Rivera, Sunrise; Patrick M. Dunn, Coral Springs, all of Fla.

[73] Assignee: Motorola, Inc., Schaumburg, Ill.

[21] Appl. No.: 08/971,303

[22] Filed: Nov. 17, 1997

[51] Int. Cl.[7] ..... G09G 3/36

[52] U.S. Cl. ..... 345/98; 345/87

[58] Field of Search ..... 345/94, 98, 99, 345/87, 96, 101, 208, 209

[56] References Cited

U.S. PATENT DOCUMENTS

| | | | |
|---|---|---|---|
| 4,901,066 | 2/1990 | Kobayashi et al. | 340/805 |
| 5,262,881 | 11/1993 | Kuwata et al. | 345/93 |
| 5,459,495 | 10/1995 | Scheffer et al. | 345/147 |
| 5,754,157 | 5/1998 | Kuwata et al. | 345/100 |
| 5,774,103 | 8/1998 | Choi et al. | 345/94 |
| 5,910,793 | 6/1999 | Rogovin et al. | 345/100 |

*Primary Examiner*—Amare Mengistu
*Assistant Examiner*—Jimmy Hai Nguyen
*Attorney, Agent, or Firm*—Frank M. Scutch, III

[57] ABSTRACT

A method of multiplex driving a passive liquid crystal display (LCD) using a bi-level LCD multiplex driver for providing one or more bi-level waveforms on the ROW/common lines and COLUMN/segment lines of a multiplexed liquid crystal display (LCD). These waveforms drive the LCD display using binary data from display memory locations. At periodic intervals the machine state is advanced with the present state used to 1) look-up in a table the bi-level data to output on the ROW/commons, and 2) look-up memory locations associated with the active COLUMN/segments; and 3) to provide inverted COLUMN/segments data before sending the bi-level data to the COLUMN/segment lines of the LCD. The states advance four times the number of ROW/commons before being reset to the initial state and the waveforms repeated. Thus, the machine produces one ON/select voltage and one OFF/non-select voltage are provided to the LCD according to predetermined formulas.

6 Claims, 4 Drawing Sheets

INTEGRATED MULTIPLEX DRIVE SYSTEM FOR A PASSIVE LIQUID CRYSTAL DISPLAY (LCD) USING MODULATED PULSE WIDTHS

CROSS REFERENCE TO RELATED APPLICATIONS

This application is related to pending U.S. application Ser. No. 08/847,646, filed Apr. 30, 1997, by Ellis, et al., and assigned to Motorola, Inc.

TECHNICAL FIELD

This invention relates in general to electronic display of information and more particularly to liquid crystal display (LCD).

BACKGROUND

Many electronic consumer products today utilize some type of electronic display. This display may offer almost any type of numerical or graphical information to the user relating to status and/or mode of operation of the electronic device. Depending on the type of display that is to be used, there are many types of technologies available for driving the display in order to display the required information. As seen in prior art FIG. 1, a microprocessor is used with a display driver and resister network to drive i.e. supply information to the LCD display.

One such LCD display is a twisted nematic (TN) display. The TN display is commonly used because it is capable of displaying a moderate amount of information to the user while still maintaining low cost with minimal implementation effort. In order to optimize display functionality, a number of low cost liquid crystal display solutions have been developed for use with the TN display using Pulse Width Modulation (PWM). These techniques utilize a driving scheme that enables a multiple character TN display to be incorporated into an electronic device using a limited number of control lines from an associated microprocessor. This type of scheme eliminates the need for all external components and thus can greatly reduce the manufacturing cost of the display.

For example, a standard liquid crystal display multiplex (LCD MUX) drive operates by addressing/selecting a single row of the LCD at a time. After this selection, the desired ON/OFF states are applied to that selected Row through the LCD columns which are common to all ROWs. Rows are selected in a continuing round-robin fashion. Only when a row is addressed/selected, do the states on the columns affect a row, otherwise on unselected rows, the column states are seen as low level noise. Therefore, Table 1 shows each row supplied with the following type of waveform:

TABLE 1

| Row selected | Column 1 | Column x |
|---|---|---|
| unselected | low level noise | low level noise |
| selected | significant on/off info | significant on/off info |
| unselected | low level noise | low level noise |
| unselected | low level noise | low level noise |

As is evident to those skilled in the art, time division is being used to select one row at a time. The method of selecting the row is by supplying the row selected with voltage amplitude several times the level of unselected rows. The method of selecting the row is therefore voltage division multiplexing.

Voltage division multiplexing is a technique requiring more than two driven voltage levels. This technique is not possible with digital circuitry since digital circuitry by definition is limited to two voltage levels. Thus, in modern day electronic equipment that includes an multiplexed LCD display, some type of analog circuitry is required to interface the multiplexed LCD to the equipment's control circuits. In general, digital circuits are smaller and less costly than analog circuits for similar functions, and therefore an all digital multiplexed LCD drive scheme would be of smaller size and less costly to implement than an analog multiplexed LCD drive scheme.

Accordingly, the need exists for a digital drive scheme for an LCD multiplexed display that can be used with electronic devices and circuits having easy implementation and low cost.

DETAILED DESCRIPTION OF THE PREFERRED EMBODIMENT

Figure 2:
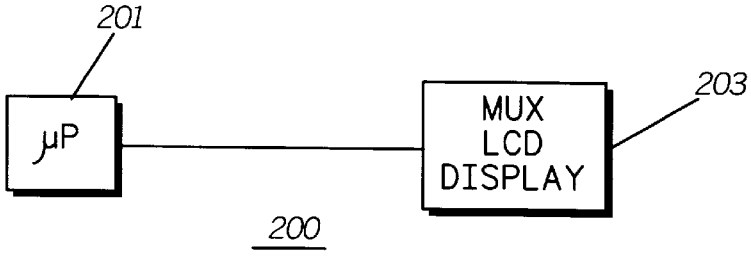
FIG. 2 is block diagram showing operation the multiplexed liquid crystal display according to the preferred method of the invention.
Figure 3:
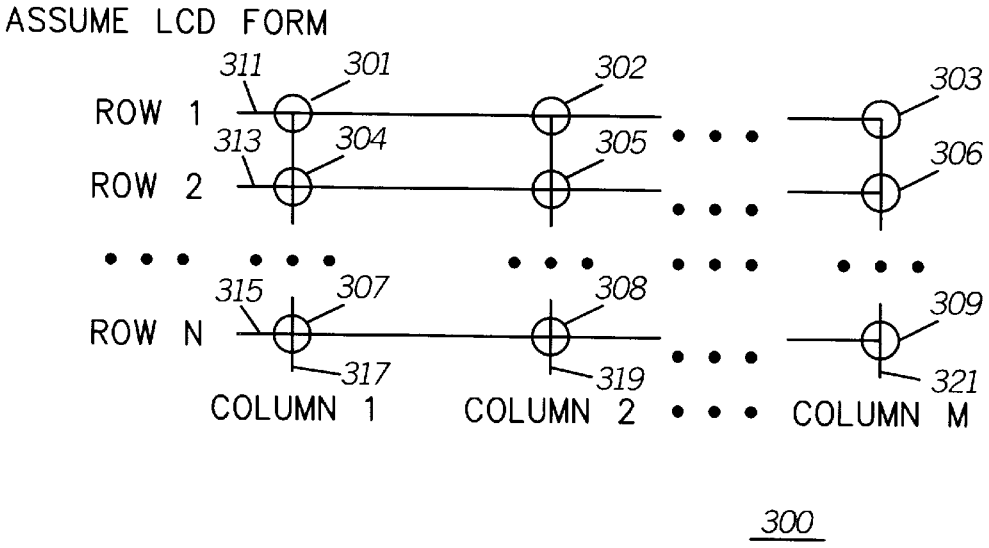
FIG. 3 is a diagram illustrating the row and column structure of a typical LCD display.

Referring now to FIGS. 2 and 3, a block diagram 200 shows the preferred architecture of the preferred embodiment of the invention. A microprocessor 201 is used to drive a multiplexed liquid crystal display (LCD) 203. As is evident from the operation of the invention, the display driver and resistor biasing network as used in the prior art have been eliminated.

Figure 1:
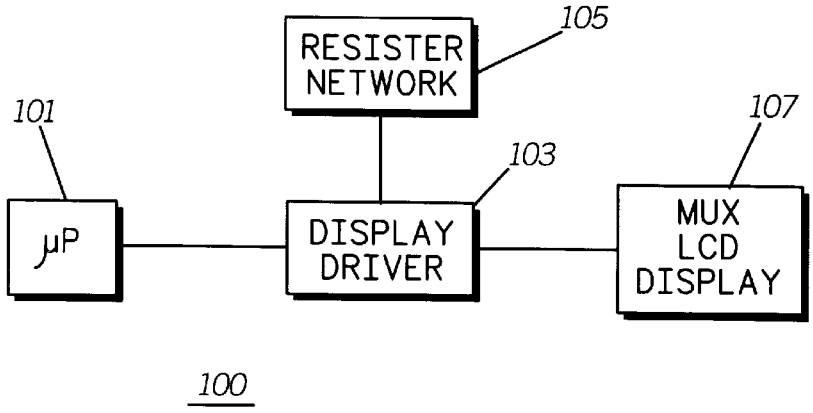
FIG.1 (PRIOR ART)
FIG. 1 is a prior art block diagram showing the standard drive scheme for liquid crystal displays.

For an LCD display to be designed into a product in typical fashion requires that an LCD driver integrated circuit (IC) be provided to control the LCD FIG. 1. Several costs are associated with the use of an LCD driver which include the cost of the LCD driver IC 103, the cost of a resistor divider network 105 to provide multiple drive voltage levels, a power supply booster to generate drive voltages needed for medium multiplex rates, and power supply control to implement temperature compensation for the LCD, all part of the LCD driver 103. The LCD driver IC 103 along with its support circuitry 105 also add cost in that the printed circuit board (PCB) area of the product increases to hold the extra circuitry. This increase in area may also increase the overall size and weight of the product. Substantial cost savings are achieved using the invention described herein because the need for the driver boosted power supply, power supply resistor divider network 103, and power supply adjustment circuits for temperature compensation are eliminated.

In the preferred embodiment, the product LCD driver or microprocessor with imbedded LCD driver 201 is used to drive the LCD 203 in the electronic device. As compared with typical LCD driver IC parts, the PWM driver does not need the boosted power supply voltage, the resistor dividers, nor a power supply adjustment for temperature compensation. Additionally, the PWM LCD drive provides comparable display contrast quality when refreshing the display at half the speed of standard drive techniques. This reduction in speed translates into lower power dissipation and improved product battery life.

One problem of PWM LCD MUX drive method as compared to standard LCD MUX drive schemes is that as the PWM multiplex rate increases, the select and non-select voltages, as seen by the liquid crystal material, move closer together. This has the effect of placing more stringent performance criteria on the liquid crystal requiring the transition between select and non-select states to become more and more steep for higher multiplex rates. This phenomenon of the select/non-select voltages moving closer together will limit the use of PWM to substantially low or medium multiplex rates that are less than approximately thirty (30) multiplex ROWS with current state of the art liquid crystal materials.

In FIG. 3, a wiring diagram 300 of a multiplexed LCD illustrates the configuration of a typical LCD. Each circle 301 to 309 represents an LCD segment. An LCD segment is conceptually formed as a layered structure with the ROW conductor 311, 313, or 315 on top, a COLUMN conductor 317, 319, or 321 on bottom, and liquid crystal (not shown) in between these conductors. Assuming the display memory has one bit per display segment, eg. intersection of ROW y and COLUMN x designated Sxy where y=1 to N for ROWs and x=1 to M for COLUMNs. If the bit Sxy=1 then the corresponding LCD segment will be in an ON state, else if the bit Sxy=0 then the corresponding LCD segment will be in the OFF state.

Figure 4:
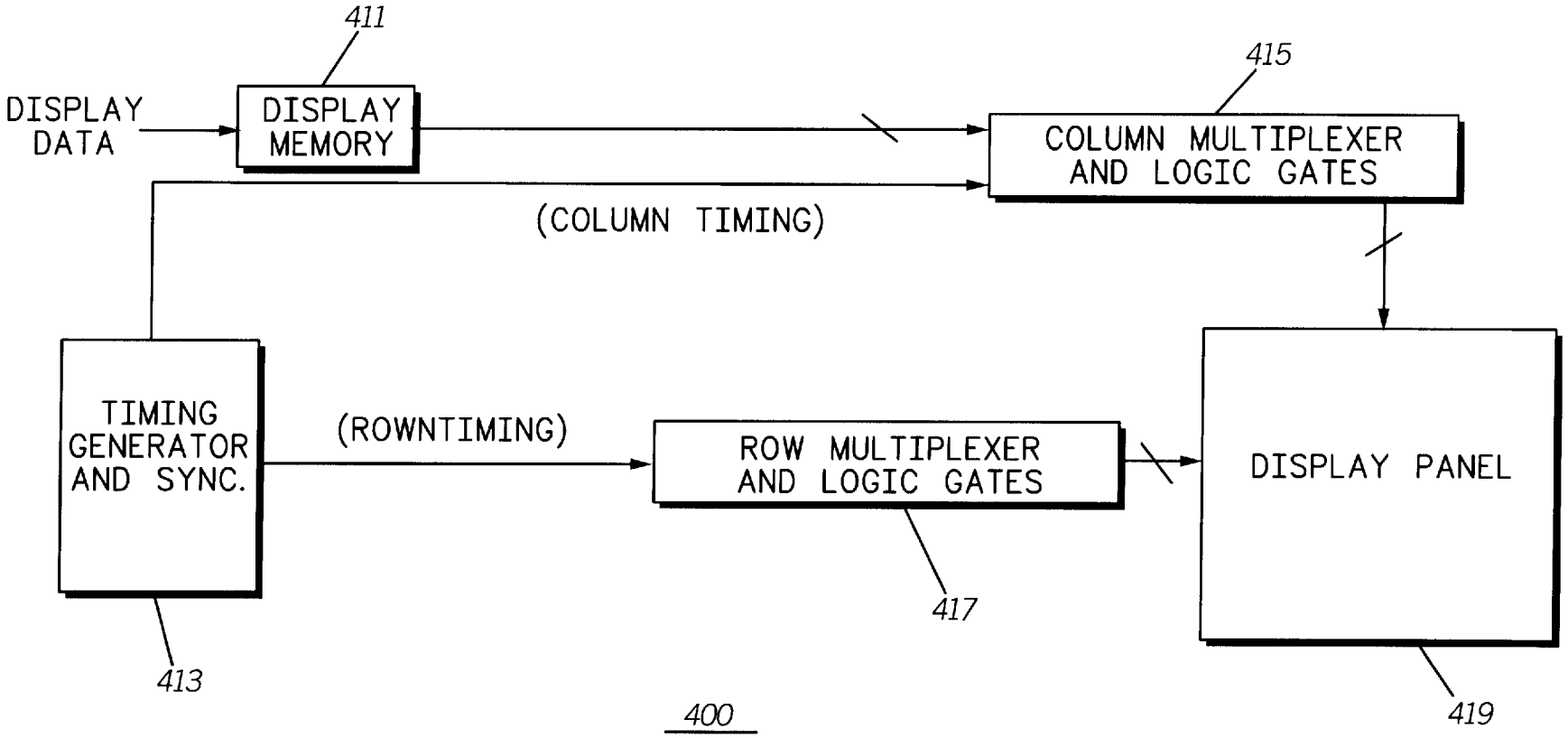
FIG. 4 is a block diagram illustrating the multiplexed liquid crystal display imbedded in a host integrated circuit.

A block diagram of a general bi-level LCD multiplex driver 400 is shown in FIG. 4 and includes a display memory 411 and a timing generator 413 that supply a synchronization signal to both a column mulitplexer 415 and row multiplexer 417. The column 215 and row multiplexer 417 are both used to provide bi-level data waveforms to the ROW and COLUMN intersections in the display panel 419.

The hardware produces bi-level waveforms on the ROW/common lines and COLUMN/segment lines of a multiplexed LCD that drive the display using the binary data from display memory locations. At periodic intervals a cycle counter is incremented. The counter value is then used to 1) generate ROW/common waveforms through ROM table look-up or through combinational logic computations, and 2) look-up memory locations associated with the active COLUMN/segments using digital multiplexer circuit blocks, 3) to invert or not invert the COLUMN/segments data before sending the bi-level data to the COLUMN/segment lines of the LCD. The cycle counter increments from zero to four times the number of ROW/commons minus one before being reset to zero and the waveforms repeated. Thus, the bi-level waveforms for the COLUMNS are formed to produce the desired ON or OFF state by either copying a binary equivalent directly to a COLUMN output port of the LCD or copying and inverting the ON or OFF state to a COLUMN output port.

Figure 5:
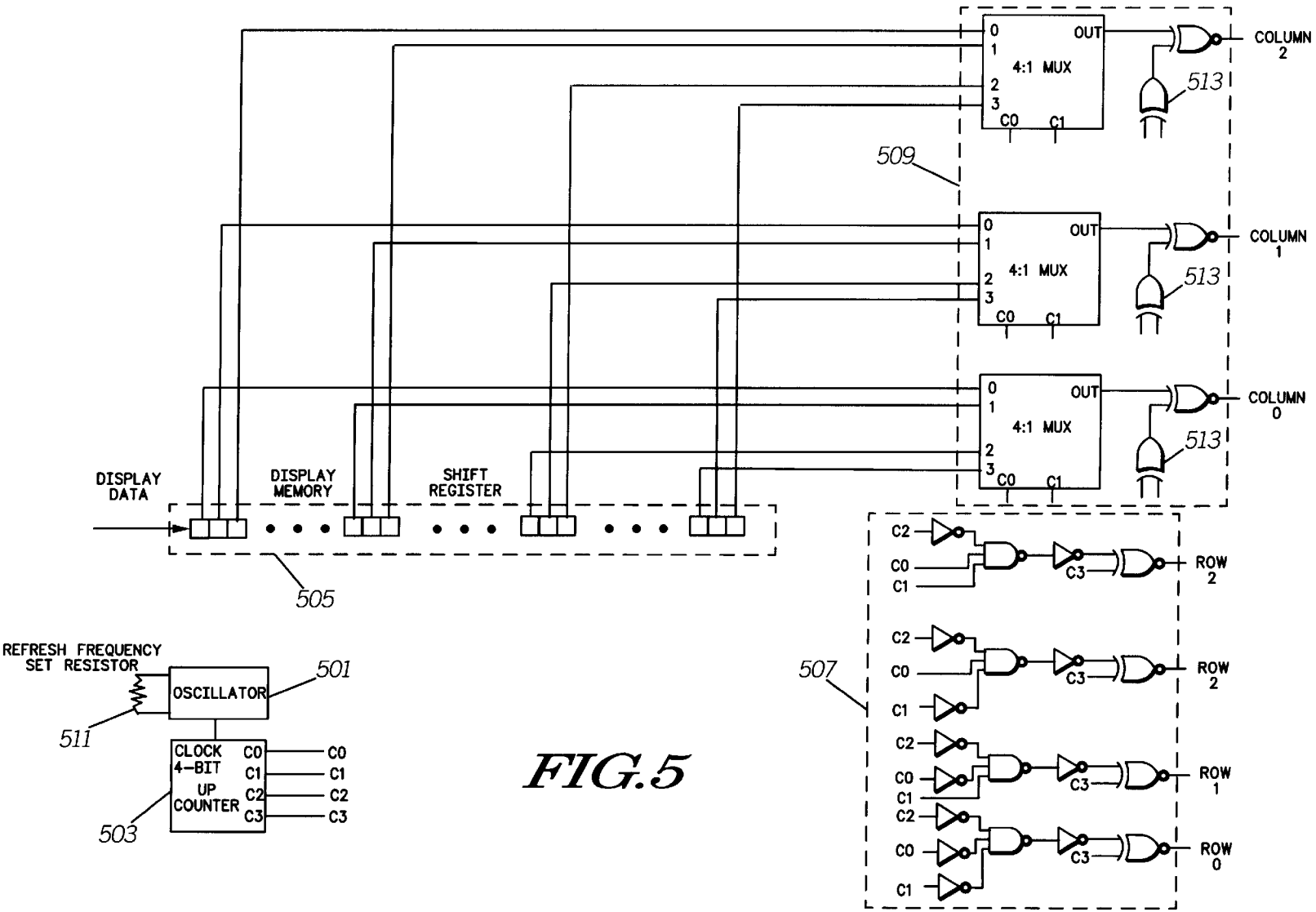
FIG. 5 is a block diagram showing a liquid crystal display having three ROWs/commons with a multiplex rate of four.

As seen in FIG. 5, The circuit consist of a long serial shift register 505 that holds the data to be displayed, an oscillator 501 and counter 503, combinational logic 507 to generate the ROW waveforms, and digital selectors/multiplexors 509 to generate the COLUMN waveforms. Each bit of the shift register 505 is associated with a particular segment of the display. Shift register bits 0, 4, 8, . . . are associated with ROW 1 and COLUMN 1, 2, 3, . . . respectively. Shift register bits 1, 5, 9, . . . are associated with ROW 2 and COLUMN 1, 2, 3, . . . respectively. Shift register bits 2, 6, 10, . . . are associated with ROW 3 and COLUMN 1, 2, 3, . . . respectively. Shift register bits 3, 7, 11, . . . are associated with ROW 4 and COLUMN 1, 2, 3, . . . respectively. The oscillator circuit produces a clock whose frequency is set by the external resistor. The oscillator clock drives a 4-bit up counter that counts 0, 1, 2, 3, 4, 5, 6, 7, 8, 9, 10, 11, 12, 13, 14, 15, 0, 1, 2, . . . Counts 0 to 7 are associated with the output of the frame and counts 8 to 15 are associated with output of the inverted frame. Bits 3 and 4 of the counter drive the Exclusive OR gates on the outputs of the ROW and COLUMN drivers to select count values when an inversion is required. The selectors choose the appropriate shift register data for the current time slot /active ROW. The combinational logic ROW waveform generators produce waves such that:

1) in the first quarter, the output is logic zero only when the sub-counter equals the row number and one the remainder of the quarter;
2) in the second quarter, the output is always logic one;
3) in the third quarter, the output is logic one only when the sub-count counter equals the row number and zero the remainder of the quarter; and
4) in the fourth quarter, the output is always logic zero.

A ROM table can also be used to generate the row waves by using the cycle counters as address inputs to the ROM, and the ROM output driving the row pins. The COLUMN wave generators consist of three types of circuitry: 1) the display memory, 2) digital multiplexers to pick off display memory contents at particular sub-intervals of each refresh cycle, and 3) combinational logic the inverts the multiplexer output depending on which refresh cycle quarter is currently being executed. The display memory holds the LCD segment on/off information. Each segment is mapped to one unique bit of display memory. A memory location with a logic one turns the corresponding segment ON and with a logic zero turns the segment OFF. The multiplexer for a particular COLUMN selects the memory bits for the segments associated with that particular COLUMN. Each bit is selected once per refresh cycle quarter for a total of four times for the entire refresh cycle. The exclusive-OR logic gates on the multiplexer outputs selectively invert the sense of the display memory bits such that the second and third quarters output inverted data and the first and fourth quarters output non-inverted data.

Driver Hardware Function State

Figure 6A:
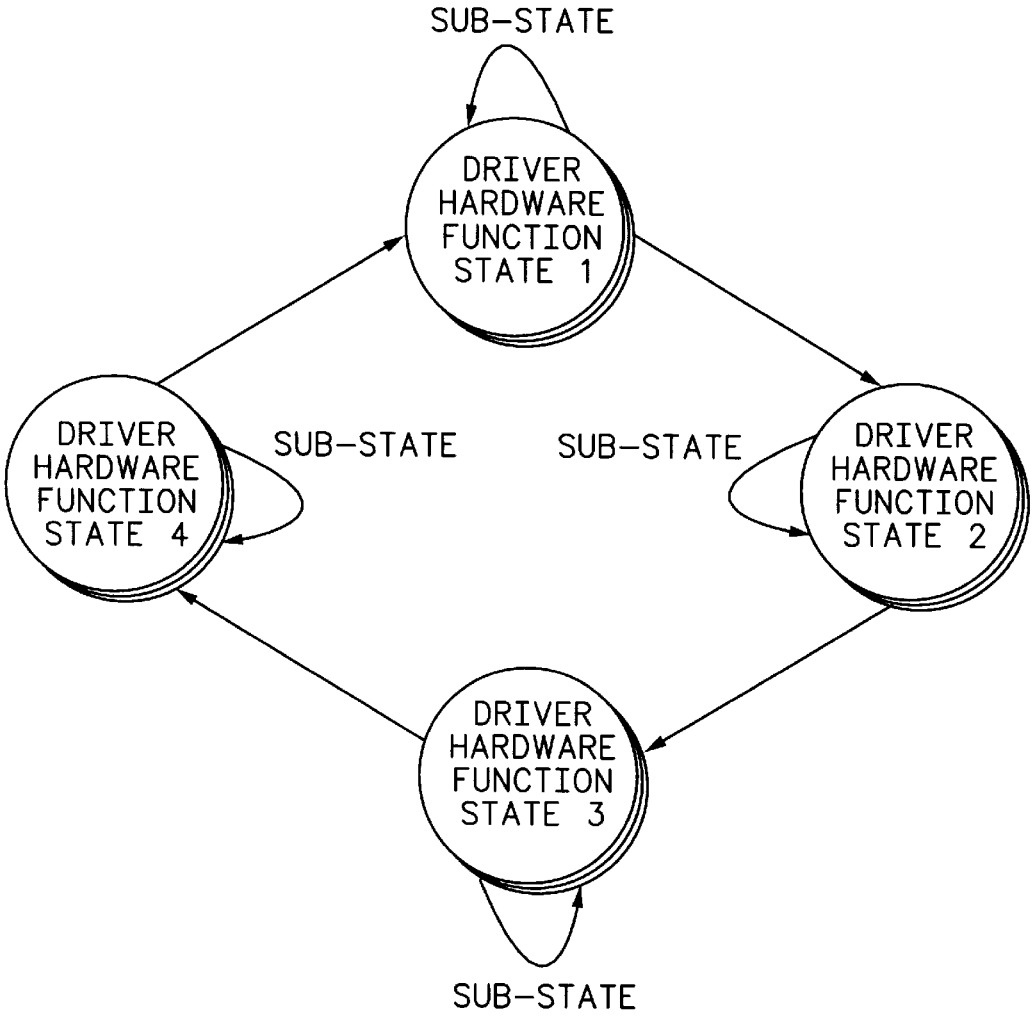
FIGS. 6A and 6B are hardware state transition diagrams illustrating the preferred method of utilizing a multiplex driver for a liquid crystal display according to the preferred embodiment of the invention.
Figure 6B:
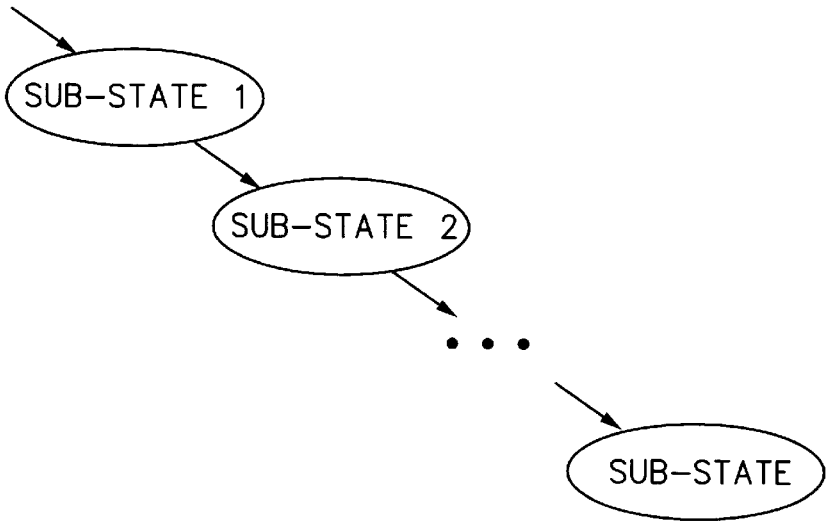

In FIGS. 6A and 6B, a state transition diagrams illustrating the preferred method of generating a multiplex drive waveform for a hardware multiplex driver implementation for a passive liquid crystal display. There are four PRIMARY states the driver hardware transitions through which constitutes a display refresh cycle. The PRIMARY states are executed continuously in round robin fashion to operate the display. Within each PRIMARY state there exist SUB-STATE states where the number of sub-states equals the multiplex rate and number of ROW lines in the display. Each sub-state is active for a few milliseconds before advancing to the next state. The order of execution of the PRIMARY and SUB-STATE states is not critical except that all states must be entered once per display refresh cycle. In Table 2, the ROW data patterns for each PRIMARY and SUB-STATE state are shown. Table 3 shows the COLUMN data patterns, that is, the display memory locations selected for output, for each PRIMARY and SUB-STATE state.

In PRIMARY STATE 1 the display memory data is driven on the COLUMN lines with only one ROW line in the active LOW polarity in any one sub-state. During each sub-state time a particular value of display memory is output as COLUMN data and the associated ROW data pattern is also driven onto the display. After all display memory values have been output and therefore all ROWs have been active one time the driver moves to the next PRIMARY STATE.

In PRIMARY STATE 2 the display memory data is INVERTED then driven on the COLUMN lines with all ROW lines at HIGH polarity. During each sub-state time a particular value of display memory is output as COLUMN data and is driven onto the display. After all display memory values have been output one time in inverted form the driver moves to the next PRIMARY STATE.

In PRIMARY STATE 3 the display memory data is INVERTED then driven on the COLUMN lines with only one ROW line in the active HIGH polarity in any one sub-state. During each sub-state time a particular value of display memory is output as COLUMN data and the associated ROW data pattern is also driven onto the display. After all display memory values have been output in inverted form and therefore all ROWs have been active one time the driver moves to the next PRIMARY STATE.

In PRIMARY STATE 4 the display memory data is driving on the COLUMN lines with all ROW lines at LOW polarity. During each sub-state time a particular value of display memory is output as COLUMN data and is driven onto the display. After all display memory values have been output one time in inverted form the driver moves to the next PRIMARY STATE.

For example, those skilled in the art will recognize that because the ROW and COLUMN are being driven with bi-level waveforms, that are of equivalent amplitude, a voltage potential will either be applied to a particular segment or zero voltage potential will be applied to that particular segment during each and every display update time period. The sum of the display update time periods form a display refresh waveform. This PWM technique operates at the most basic level since a non-zero voltage potential is applied to an LCD segment for greater than 50% of the refresh waveform duty cycle to turn the segment ON and for less than 50% of the refresh waveform duty cycle to turn the segment OFF. To preserve the integrity of the liquid crystal material, the bi-level LCD multiplex driver hardware produces the same number of non-zero positive voltage potential time periods and non-zero negative voltage potential time periods or pulses during a complete display refresh waveform cycle or period.

The multiplexing is accomplished by manipulating the waveform on the COLUMN lines such that in relation to a fixed repeating pattern on the ROW lines each individual segment is controlled to the proper ON or OFF state. The ROW lines are stimulated with a fixed repeating pattern that applies binary waveforms that are mathematically orthogonal to each other. This is accomplished by supplying or 'marching a logic zero' through the first quarter of the ROW wave and 'marching a logic 1' through the third quarter of the ROW wave. The second quarter and fourth quarter of the ROW wave is needed to assure that only one select and one non-select voltage is produced.

The manipulation of COLUMN data follows a simple rule with respect to the repeating ROW waves of the preceding paragraph. In the first quarter of the LCD refresh cycle, the position of the marching 0 logically marks that ROW as active. The ON/OFF LCD segment data for the active ROW is placed on the COLUMN lines during the cycle first quarter. In the third quarter of the LCD refresh cycle, the position of the marching logical 1 marks that ROW as active. During the time periods of the second quarter, the COLUMN data waveform that was output during the cycle first quarter is repeated but in logically inverse form. The inverse of the ON/OFF LCD segment data for the active ROW is placed on the COLUMN lines during the cycle third quarter. During the time periods of the fourth quarter, the COLUMN data waveform that was output during the cycle first quarter is repeated.

A check of all possible ON/OFF segment combinations when applying the PWM algorithm will show that only one select and one non-select voltage is produced at each LCD segment and that the voltage produced is select when the segment data is set to be ON and non-select when the segment data is to be OFF. LCD MUX rates for three, four, and five multiplex ROWs were exhaustively checked and verified. By mathematical induction, the PWM LCD MUX drive scheme can be extended to any desired MUX rate. A display with 29 multiplexed ROWs has been constructed and operates well using the PWM MUX LCD drive technique.

As will be evident to those skilled in the art, the voltage difference seen by each LCD segment 301 to 309 formed by the segment's corresponding ROW and COLUMN values determines the segment waveform shape. The standard LCD MUX method applies all of the select voltage in a single time period of the display refresh cycle. In contrast, the PWM LCD MUX drive method of the invention does not operate in this fashion. Instead PWM LCD MUX spreads the select voltage over the entire display refresh cycle. In the present invention, there is no difference between the ROW select and non-select voltage amplitude. In operation, each ROW is addressed while a portion of a root mean squared (RMS) voltage may be added to each LCD segment. The sum total of all the RMS voltage portions cause the PWM LCD segment to be either in an ON or OFF state In Tables 2a through 2d and Tables 3a through 3d below, waveform data for each ROW of the liquid crystal display is used for the state transition diagram illustrated in FIGS. 7A and 7B. Note that N equal the n display multiplex rate and the number of ROW lines on the display.

TABLE 2a

ROW data for SUB-STATEs of PRIMARY STATE 1

| SUB-STATE No. | ROW 1 | ROW 2 | . . . | ROW N |
|---|---|---|---|---|
| 1 | 0 | 1 | | 1 |
| 2 | 1 | 0 | | 1 |
| . . . | . . . | . . . | | . . . |
| N | 1 | 1 | . . . | 0 |

TABLE 2b

ROW data for SUB-STATEs of PRIMARY STATE 2

| SUBSTATE No. | ROW 1 | ROW 2 | . . . | ROW N |
|---|---|---|---|---|
| 1 | 0 | 0 | | 0 |
| 2 | 0 | 0 | | 0 |
| . . . | . . . | . . . | | . . . |
| N | 0 | 0 | . . . | 0 |

TABLE 2c

| ROW data for SUB-STATEs of PRIMARY STATE 3 | | | | |
|---|---|---|---|---|
| SUBSTATE No. | ROW 1 | ROW 2 | . . . | ROW N |
| 1 | 1 | 0 | | 0 |
| 2 | 0 | 1 | | 0 |
| . . . | . . . | . . . | | . . . |
| N | 0 | 0 | . . . | 1 |

TABLE 2d

| ROW data for SUB-STATEs of PRIMARY STATE 4 | | | | |
|---|---|---|---|---|
| SUBSTATE No. | ROW 1 | ROW 2 | . . . | ROW N |
| 1 | 1 | 1 | | 1 |
| 2 | 1 | 1 | | 1 |
| . . . | . . . | . . . | | . . . |
| N | 1 | 1 | . . . | 1 |

Table 3: COLUMN data/display memory location versus driver state. Note N equals the display multiplex rate and the number of ROW lines, and M equals the number of COLUMN lines on the display. "*" indicates to invert the bit value.

TABLE 3a

| COLUMN data for SUB-STATEs of PRIMARY STATE 1 | | | | |
|---|---|---|---|---|
| SUBSTATE No. | COLUMN 1 | COLUMN 2 | . . . | COLUMN M |
| 1 | S(1,1) | S(2,1) | | S(M,1) |
| 2 | S(1,2) | S(2,2) | | S(M,2) |
| . . . | . . . | . . . | | . . . |
| N | S(1,N) | S(2,N) | . . . | S(M,N) |

TABLE 3b

| COLUMN data for SUB-STATEs of PRIMARY STATE 2 | | | | |
|---|---|---|---|---|
| SUBSTATE No. | COLUMN 1 | COLUMN 2 | . . . | COLUMN M |
| 1 | *S(1,1) | *S(2,1) | | *S(M,1) |
| 2 | *S(1,2) | *S(2,2) | | *S(M,2) |
| . . . | . . . | . . . | | . . . |
| N | *S(1,N) | *S(2,N) | . . . | *S(M,N) |

TABLE 3c

| COLUMN data for SUB-STATEs of PRIMARY STATE 3 | | | | |
|---|---|---|---|---|
| SUBSTATE No. | COLUMN 1 | COLUMN 2 | . . . | COLUMN M |
| 1 | *S(1,1) | *S(2,1) | | *S(M,1) |
| 2 | *S(1,2) | *S(2,2) | | *s(M,2) |
| . . . | . . . | . . . | | . . . |
| N | *S(1,N) | *S(2,N) | . . . | *S(M,N) |

TABLE 3d

| COLUMN data for SUB-STATEs of PRIMARY STATE 4 | | | | |
|---|---|---|---|---|
| SUBSTATE No. | COLUMN 1 | COLUMN 2 | . . . | COLUMN M |
| 1 | S(1,1) | S(2,1) | | S(M,1) |
| 2 | S(1,2) | S(2,2) | | S(M,2) |

TABLE 3d-continued

| COLUMN data for SUB-STATEs of PRIMARY STATE 4 | | | | |
|---|---|---|---|---|
| SUBSTATE No. | COLUMN 1 | COLUMN 2 | . . . | COLUMN M |
| . . . | . . . | . . . | | . . . |
| N | S(1,N) | S(2,N) | . . . | S(M,N) |

To summarize, the method of the present invention produces bi-level waveforms on the ROW/common lines and COLUMN/segment lines of a multiplexed LCD that drive the display using the binary data from display memory locations. At periodic intervals the driver steps through a set of states. Depending on the present state, a bi-level data pattern is output on the ROW/commons, and data values or their inverse from display memory locations associated with the active ROW are output on the COLUMN/segment lines of the LCD. There are four times the number of ROW/commons SUBSTATE states and each is entered once before the driver is reset and the waveforms repeated.

The hardware produces one ON/select voltage and one OFF/non-select voltage according to the following formulas. ON/select and OFF/non-select voltages are in alternating current root mean square (AC RMS) units:

ON/select voltage:

$$V_{ON} = \sqrt{\frac{\text{NUMBER OF ROW/COMMON LINES} + 1}{2(\text{NUMBER OF ROW/COMMON LINES})}} * \text{PULSE AMPLITUDE VOLTAGE}$$

OFF/non-select voltage:

$$V_{OFF} = \sqrt{\frac{\text{NUMBER OF ROW/COMMON LINES} - 1)}{2(\text{NUMBER OF ROW/COMMON LINES})}} * \text{PULSE AMPLITUDE VOLTAGE}$$

Thus, the ON/select and OFF/non-select voltages formulas above follow from a graphical analysis of the pulses seen by a LCD segment stimulated by the PWM algorithm. The segment will be ON when it is pulsed greater than 50% of the time and the segment will be OFF when it is pulsed less than 50% of the time during a LCD refresh cycle. Because the LCD refresh cycle is four (4) times the desired MUX rate, the refresh cycle will have an even number of time slots. Also, because the second half of the refresh cycle is identical but inverted from the cycle first half, an ON segment will see pulses greater than half the time of the half cycle time and an OFF segment will see pulses less than half the time of the half cycle. This constrains the ON calculation to be the first number above 50% that can be achieved with integer multiples of the MUX rate which is the same as the number of ROW lines/common lines. Similarly, this constrains the OFF calculation to be the first number below 50% that can be achieved with integer multiples of the MUX rate which is the same as the number of ROW lines/common lines.

While the preferred embodiments of the invention have been illustrated and described, it will be clear that the invention is not so limited. Numerous modifications, changes, variations, substitutions and quivalents will occur to those skilled in the art without departing from the spirit and scope of the present invention as defined by the appended claims.

What is claimed is:

1. A method of producing a bi-level waveform on the ROW/common lines and the COLUMN/segment lines of a multiplexed liquid crystal display (LCD) using a non-zero crossing bi-level LCD multiplex driver and a predetermined algorithm for driving the output of the display with binary data from at least one display memory location, comprising the steps of:

a) initializing a hardware to a beginning state;

b) determining a first predetermined non-zero crossing bi-level data waveform;

c) sending the first predetermined non-zero crossing bi-level data waveform to a ROW/common of the LCD based upon the present hardware state;

d) determining a second predetermined non-zero crossing bi-level data waveform;

e) sending the second predetermined non-zero crossing bi-level data waveform to a COLUMN/segment of the LCD based upon the present hardware state;

f) delaying for a subsequent LCD refresh period;

g) determining a subsequent hardware state based on the current hardware state, such that if the number of states entered equals four times the number of LCD ROW/commons in the LCD;

h) reinitializing the machine state as in step a) or determining a new first predetermined non-zero crossing bi-level data waveform as in step b) and continuing steps c) through g) thereafter.

2. A method of producing a non-zero crossing bi-level waveform as in claim 1 wherein the first predetermined non-zero crossing bi-level data waveform is determined using a first look-up table.

3. A method of producing a non-zero crossing bi-level waveform as in claim 2 wherein the second predetermined non-zero crossing bi-level waveform is determined using a second look-up table.

4. A method of producing a non-zero crossing bi-level waveform as in claim 3 wherein the LCD maybe temperature compensated by modifying values in either the first look-up table or second look-up table.

5. A method of producing a plurality of non-zero crossing bi-level display waveforms as in claim 1, wherein the bi-level display data in step c) and step d) are either an ON/select voltage or an OFF/on-non-select voltage that is used for displaying information on segments of the LCD.

6. A method of producing a plurality of non-zero crossing bi-level display waveforms as in claim 1, wherein the bi-level LCD multiplex driver is constructed entirely of discrete electronic components.

* * * * *